US012385354B2

(12) United States Patent
Thompson

(10) Patent No.: US 12,385,354 B2
(45) Date of Patent: Aug. 12, 2025

(54) SAFETY VALVE, METHOD, AND SYSTEM

(71) Applicant: Baker Hughes Oilfield Operations LLC, Houston, TX (US)

(72) Inventor: Grant Thompson, Tulsa, OK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/508,802

(22) Filed: Nov. 14, 2023

(65) Prior Publication Data

US 2025/0154850 A1 May 15, 2025

(51) Int. Cl.
*E21B 34/08* (2006.01)

(52) U.S. Cl.
CPC ..... *E21B 34/08* (2013.01); *E21B 2200/05* (2020.05)

(58) Field of Classification Search
CPC ..... E21B 34/08; E21B 34/105; E21B 34/106; E21B 2000/05
See application file for complete search history.

(56) References Cited

U.S. PATENT DOCUMENTS 4,782,895 A 11/1988 Jacob et al.
5,465,786 A * 11/1995 Akkerman ..... E21B 34/06 166/66.4
6,253,843 B1 7/2001 Rawson et al.
6,513,594 B1 * 2/2003 McCalvin ..... E21B 34/10 166/332.3
6,607,037 B2 8/2003 Thompson
8,511,374 B2 * 8/2013 Scott ..... E21B 34/106 166/381
10,745,997 B2 8/2020 Burris et al.
(Continued)

FOREIGN PATENT DOCUMENTS

EP 2129866 B1 9/2014
JP 2014512495 A 5/2014
(Continued)

OTHER PUBLICATIONS

The Lee Company; Product Information Sheet—Lee Burst-Sert Rupture Disc; Aug. 2021; 2 pages; https://www.theleeco.com/uploads/2021/11/ProductInformationSheet2021-08-LeeBurst-SertRuptureDisc.pdf.
(Continued)

*Primary Examiner* — Giovanna Wright
(74) *Attorney, Agent, or Firm* — CANTOR COLBURN LLP

(57) ABSTRACT

An insert safety valve, including a housing, a flow tube in the housing, a flapper to positions of the flow tube, an atmospheric chamber in the housing, a selectively openable valve to prevent or allow pressure communication between the chamber and an environment, the valve including a valve member, a valve seat, and an unseat member to move the valve member off the valve seat. A borehole system, including a preexisting safety valve having a control line, an insert safety valve, in the preexisting safety valve, the insert safety valve operable with the control line. A method for controlling a wellbore, including running an insert safety valve while preventing fluid communication with an atmospheric chamber of the safety valve, moving the unseat member, and enabling fluid communication with the atmospheric chamber.

17 Claims, 6 Drawing Sheets

(56) References Cited

U.S. PATENT DOCUMENTS

| | | | | |
|---|---|---|---|---|
| 11,015,418 | B2 | 5/2021 | Burris et al. | |
| 11,111,740 | B2 | 9/2021 | Garr et al. | |
| 11,293,265 | B2 | 4/2022 | Burris et al. | |
| 2003/0019629 | A1* | 1/2003 | Thompson | E21B 34/106 166/319 |
| 2008/0128137 | A1 | 6/2008 | Anderson et al. | |
| 2008/0230231 | A1 | 9/2008 | Bolding et al. | |
| 2010/0025045 | A1* | 2/2010 | Lake | E21B 34/066 166/373 |
| 2013/0032355 | A1 | 2/2013 | Scott et al. | |
| 2015/0226030 | A1 | 8/2015 | MacKenzie et al. | |
| 2015/0275620 | A1 | 10/2015 | Scott et al. | |
| 2015/0369005 | A1 | 12/2015 | Vick, Jr. | |
| 2016/0138365 | A1 | 5/2016 | Vick, Jr. et al. | |
| 2018/0202261 | A1* | 7/2018 | Scott | E21B 34/16 |
| 2018/0340397 | A1 | 11/2018 | Lake | |
| 2018/0355698 | A1 | 12/2018 | Williamson et al. | |
| 2019/0376367 | A1 | 12/2019 | Burris et al. | |
| 2020/0048988 | A1 | 2/2020 | Vick, Jr. | |
| 2021/0108487 | A1* | 4/2021 | Vick, Jr. | E21B 23/04 |
| 2022/0341285 | A1 | 10/2022 | Werkheiser et al. | |

FOREIGN PATENT DOCUMENTS

| | | | |
|---|---|---|---|
| WO | 2017048265 | A1 | 3/2017 |
| WO | 2017204804 | A1 | 11/2017 |

OTHER PUBLICATIONS

Notification of Transmittal of the International Search Report and the Written Opinion of the International Searching Authority, or the Declaration; PCT/US2024/055885; Mail date: Feb. 21, 2025; 13 pages.

Notification of Transmittal of the International Search Report and the Written Opinion of the International Searching Authority, or the Declaration; PCT/US2024/055023; Mail Date: Feb. 20, 2025; 13 pages.

* cited by examiner

SAFETY VALVE, METHOD, AND SYSTEM

BACKGROUND

In the resource recovery and fluid sequestration industries safety valves are often employed for well control. Long service lives are paramount and yet sometimes the life of a safety valve is insufficient for the duty asked of it. In such conditions, insert safety valves are employed to substitute for the function of the previous safety valve. Axiomatically, disposing a replacement valve inside a previous valve reduces available inside diameter, which is generally contrary to desirability. Since insert valves are less expensive than complete workovers, they are not likely to disappear and hence new technologies with enhanced functionality are always desirable.

SUMMARY

An embodiment of an insert safety valve, including a housing, a flow tube movably disposed within the housing, a flapper articulated to the housing and responsive to positions of the flow tube relative to the housing, an atmospheric chamber disposed within the housing, a selectively openable valve disposed to prevent or allow pressure communication between the atmospheric chamber and an environment outside of the housing, the valve including a valve member, a valve seat, a biaser configured to urge the member against the seat, and an unseat member responsive to an external input to move the valve member off the valve seat.

An embodiment of a borehole system, including a preexisting safety valve having a control line, an insert safety valve, disposed within the preexisting safety valve, the insert safety valve configured to operate based upon input from the control line.

An embodiment of a method for controlling a wellbore, including running the insert safety valve to a location in a wellbore, preventing fluid communication with the atmospheric chamber of the safety valve during running, landing the insert safety valve, moving the unseat member, and enabling fluid communication with the atmospheric chamber.

An embodiment of a wellbore system, including a borehole in a subsurface formation, a string in the borehole, and an insert safety valve, disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
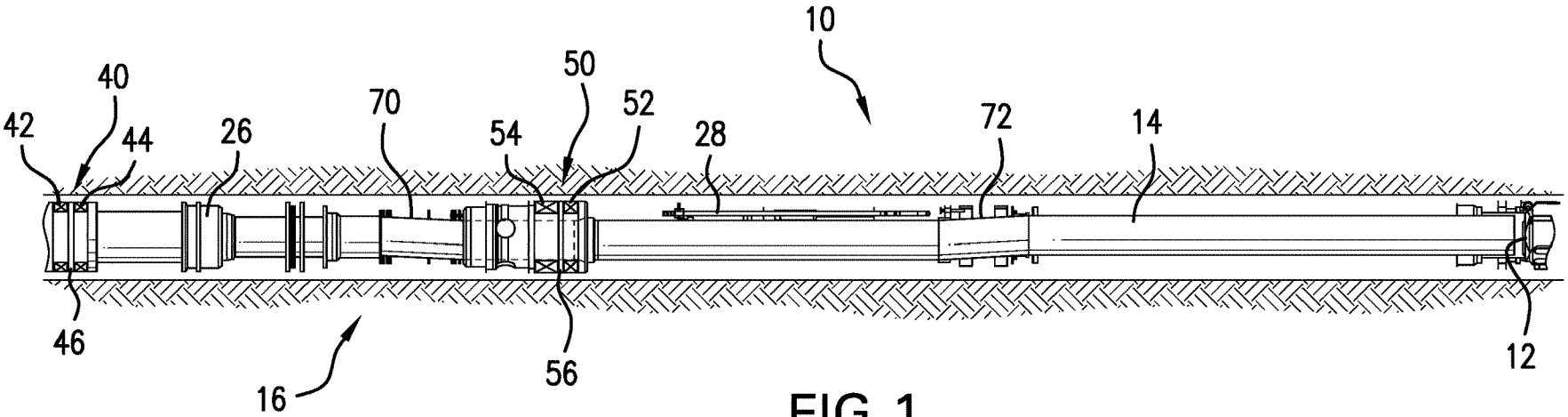
FIG. 1 is a section view of an insert valve as disclosed herein.

Referring to FIG. 1, a section view of an insert safety valve 10 is illustrated. Insert valve 10 includes a flapper 12, a flow tube 14, a control portion 16 configured to employ control line pressure from a preexisting control line 34 (see FIG. 2) to operate the insert valve 10. The insert valve 10 further includes an atmospheric chamber 22 to reduce actuation pressures required in ways known to the art. The chamber 22, in order to function properly must be maintained free of wellbore fluid during the running process. For this purpose, a selectively openable valve 46/56 is disposed in a housing 26 of the insert valve 10 in fluid communication with the atmospheric chamber 22 and between chamber 22 and tubing pressure outside of the housing 26. Atmospheric chamber 22 is also tasked with promoting a failsafe condition of the insert valve by causing the insert valve 10 to be unopenable if closed or to close if open in the event that pressure accesses the atmospheric chamber 22 other than simply by compressing the volume of the chamber 22 due to movement of a flow tube actuating piston 28. Such pressure access is a result of liquid entering the chamber 22 from either a tubing pressure source or a control pressure source.

Figure 2:
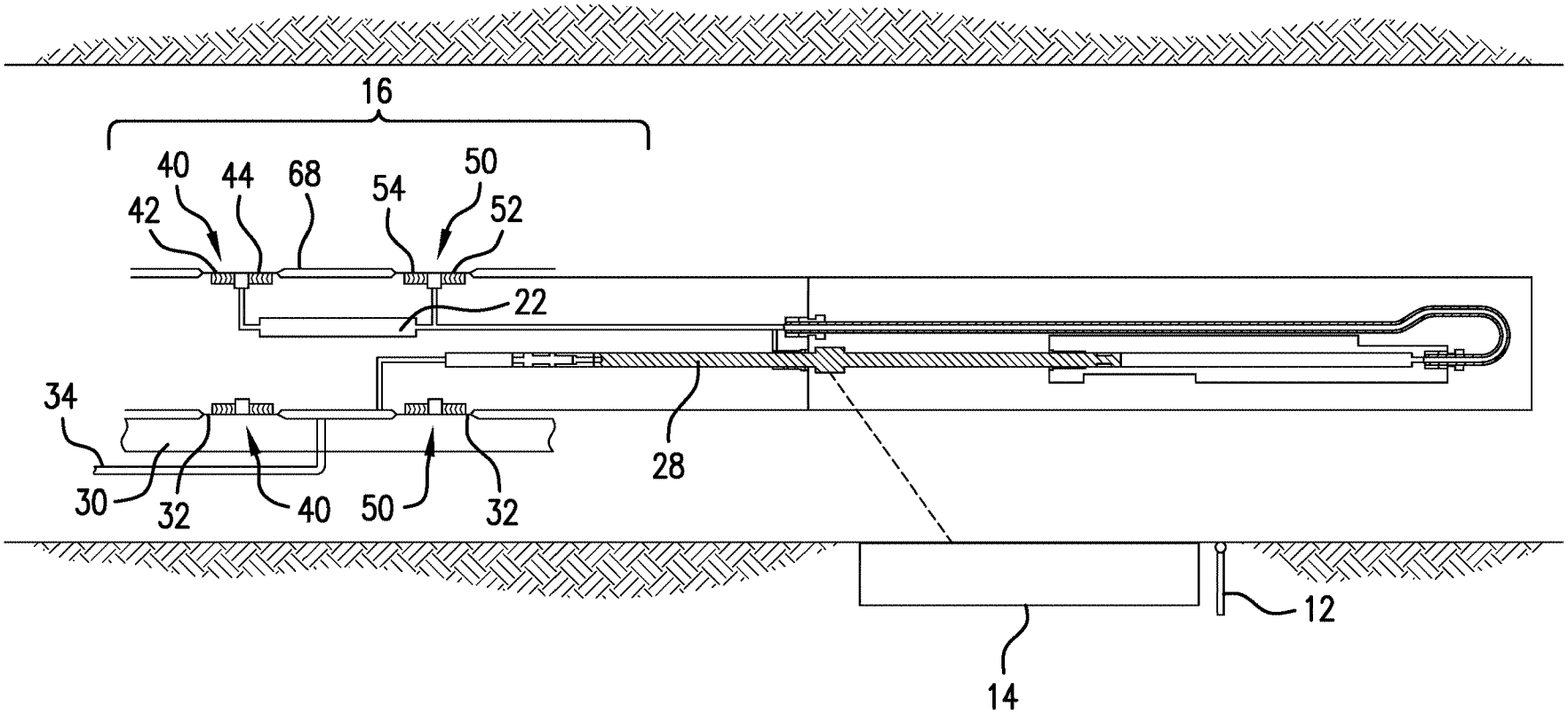
FIG. 2 is a schematic view illustrating the control system of the insert valve of FIG. 1.

The insert valve 10 is run into the borehole to a preexisting safety valve 30 (see FIG. 2). In most cases, preexisting valve 30 includes a seal bore 32 therein to accept and seal the insert valve 10 therein. The valve 30 will also have a provision for allowing access to the preexisting control line pressure. A preexisting control line 34 was in place to supply control pressure to the preexisting valve 30. Various constructions and methods exist for accessing the original control line pressure and are known to the art.

Figure 3:
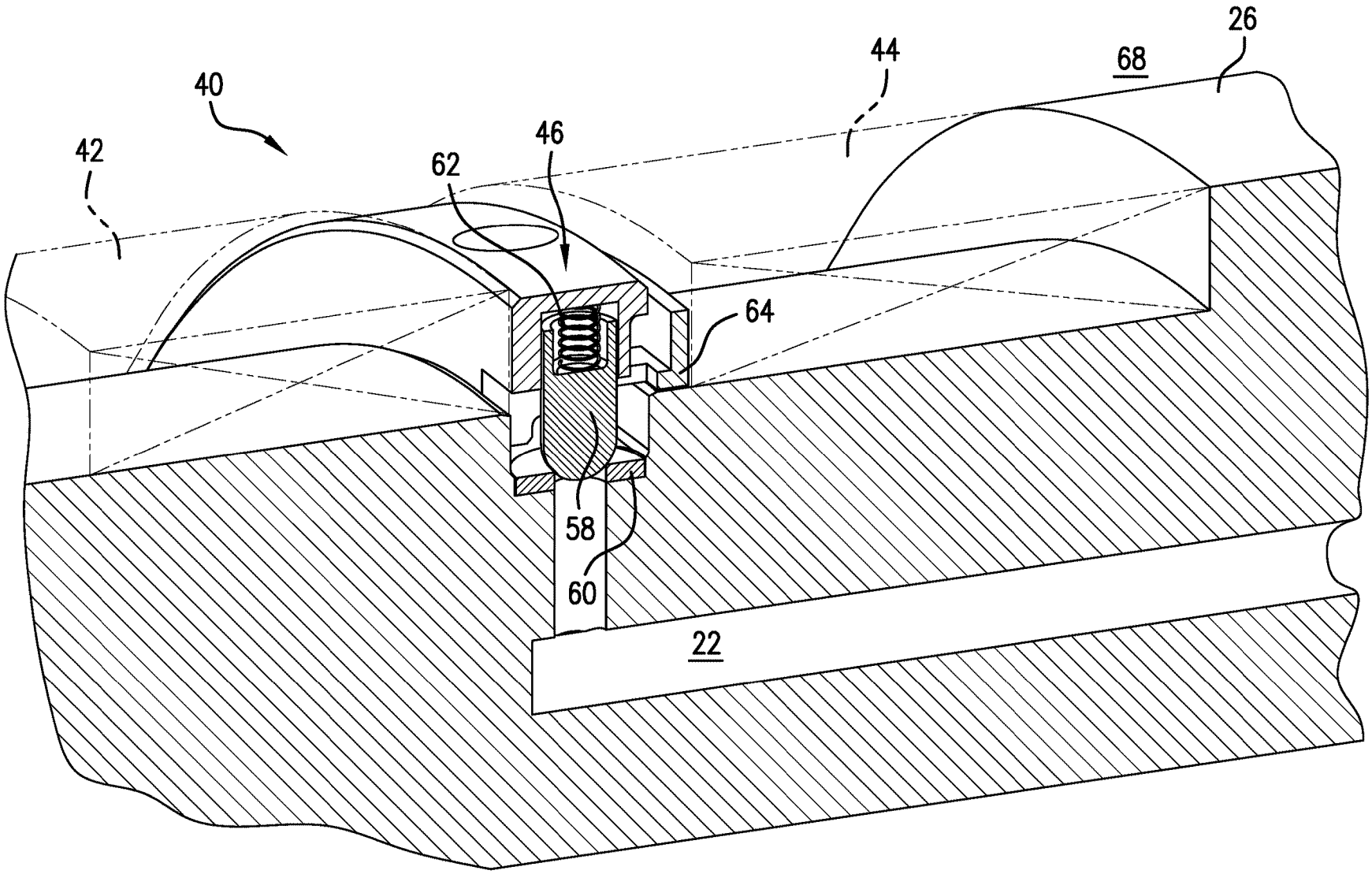
FIG. 3 is a perspective view of a selectively openable valve fluidically associated with an atmospheric chamber of the valve of FIG. 1, the openable valve in a closed position.
Figure 4:
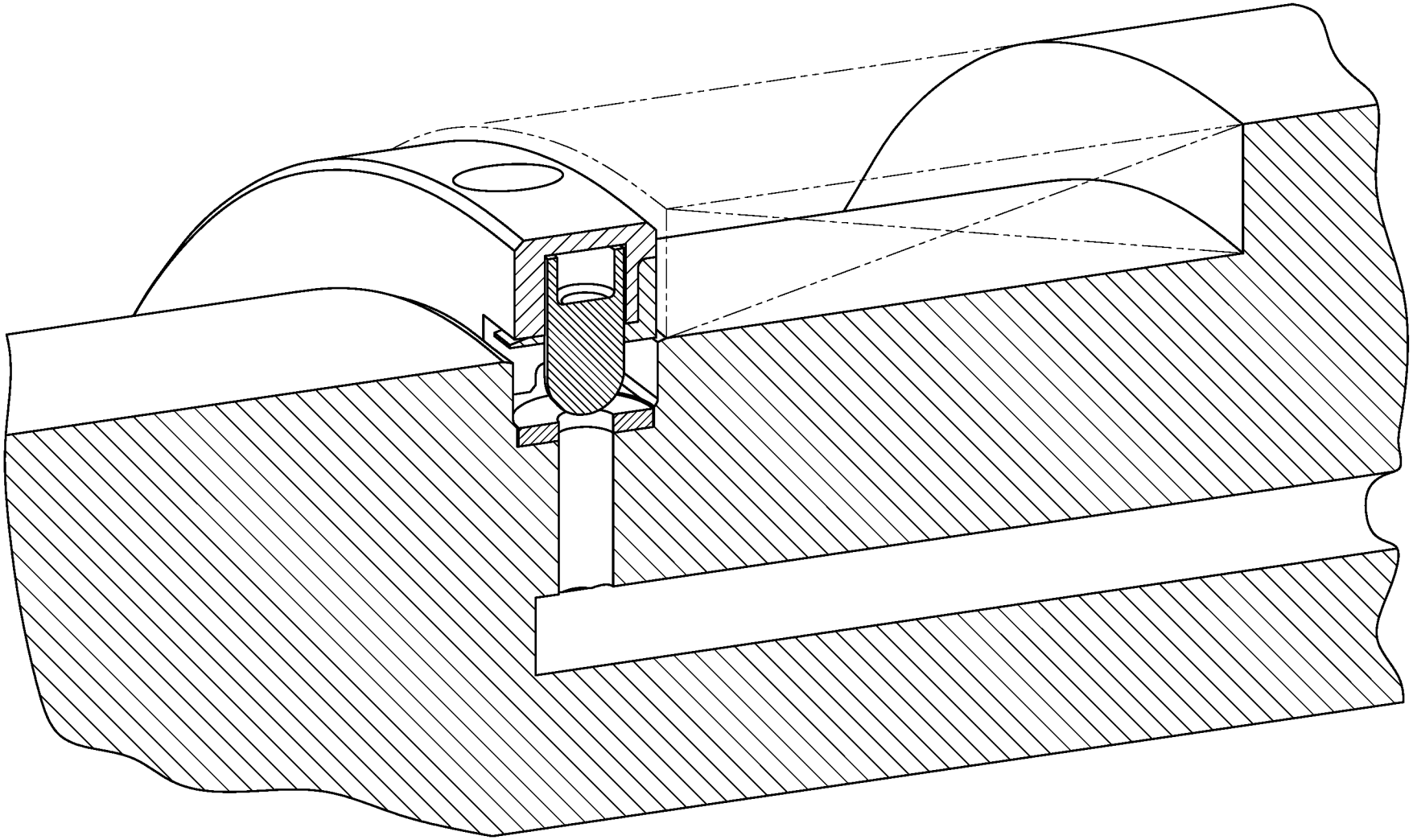
FIG. 4 is a perspective view of the selectively openable valve of FIG. 3, the openable valve in an open position.
Figure 5:
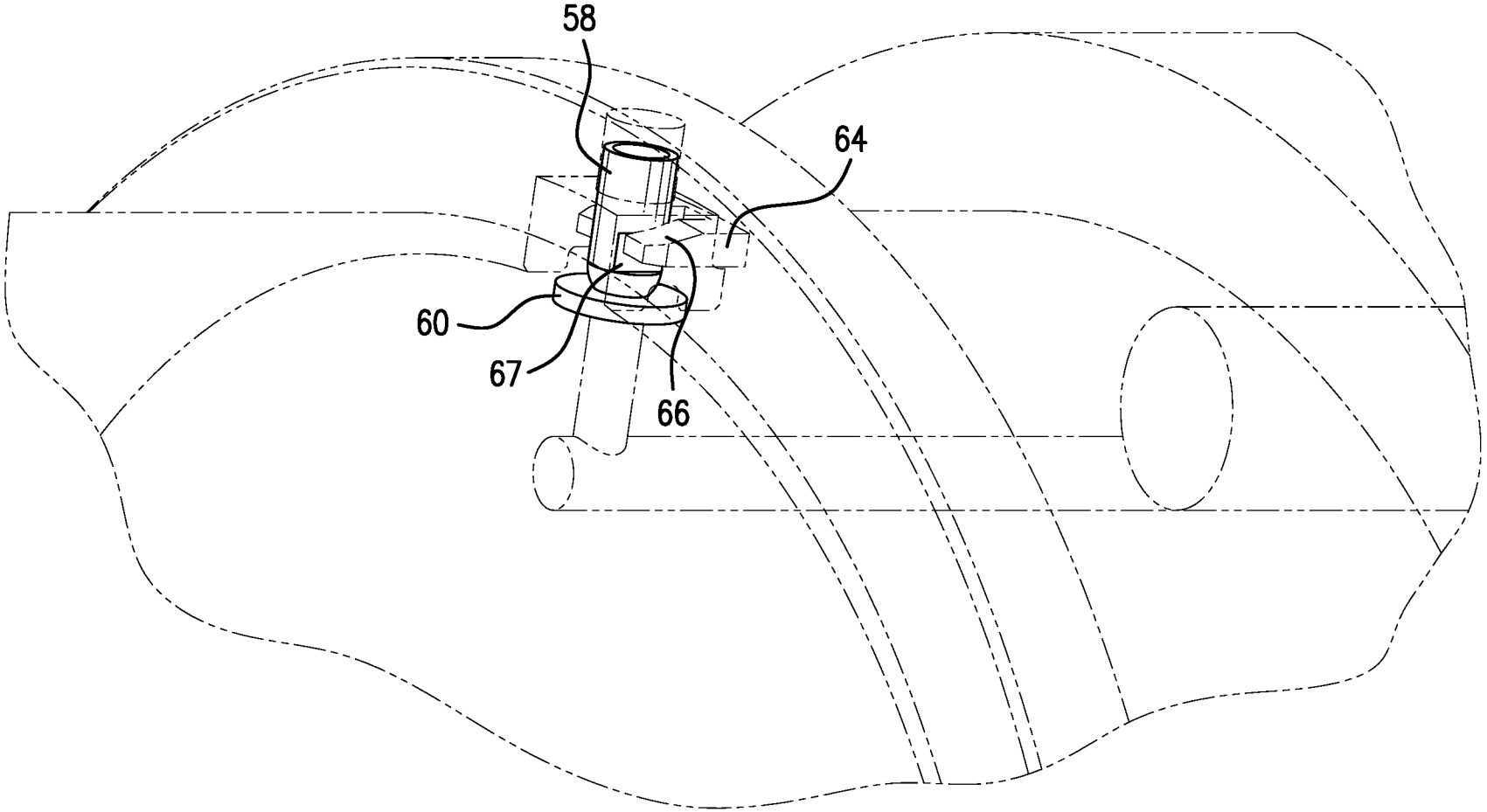
FIG. 5 is a perspective view of the openable valve 46 and related components.

Referring to FIGS. 2, 3-5 for specifics and FIG. 1 for location, insert valve 10 includes a first packing arrangement 40, having a tubing pressure side element 42 and a control pressure side element 44. A selectively openable valve 46 is disposed between the element 42 and element 44. The insert valve 10 also may comprise a second packing arrangement 50 having a tubing pressure side element 52 and a control pressure side element 54. There also may be a second selectively openable valve 56 disposed between element 52 and element 54. Openable valves 46 and/or 56 are configured with a valve member 58, a valve seat 60, a biaser 62, and a valve unseat member 64. The valve members 58 are initially seated in the valve seats 60 and prevent fluidic contact between the atmospheric chamber 22 and the environment outside of the insert valve 10. Once the insert valve 10 is landed in the preexisting valve 30 however, the openable valves 46/56 need to be opened to support function of the insert valve 10. Referring to FIG. 2, the control line 34, having been accessed by known methods, is available to provide pressure to a volume 68 between the insert valve 10 and the preexisting valve 30, and bounded by the first and second packing arrangements 40 and 50, respectively. Pressure applied to the volume 68 is control pressure that is controlled from a remote source by surface personnel or programmable controller. It is this pressure that is used to open the openable valves 46/56 and also to actuate the valve 10. Accordingly, the valves 46/56 remain closed and protective of the chamber 22 until a decision is taken to open them through the application of pressure in the control line 34. Pressurizing volume 68 causes one or both of the control side elements 44 and 54 will be moved along the housing 26 toward the unseat member 64. In FIGS. 3 and 4, only valve 46 is illustrated with surrounding structure. Valve 56 is a mirror image and so need not be detailed. Focusing on FIGS. 3 and 4, the valve member 58 is seated on seat 60 and thereby allows no fluid communication between the atmospheric chamber 22 (fluidically the chamber 22 is all of the volume behind the valve member 58) and the environment outside of the housing 26. Upon the volume 68 being pressurized, element 44 is pushed leftwardly of the figure toward the valve 46. Comparing FIGS. 3 and 4, it will be appreciated that the valve member 58 and the unseat member 64 have changed position. The element 44 has pushed the unseat member 64 toward the valve member 58. In the position of FIG. 4, the unseat member 64 physically lifts the valve member 58 off the seat 60. This can be seen in FIG. 4. Referring to FIG. 5, the unseat member 64 can be seen to exhibit a wedge 66 that engages a recess 67 of the valve member 58. The urging of the unseat member 64 closer to the valve member 58 causes the valve member 58 to climb the wedge 66 and come off the seat 60. Once off the seat, the chamber 22 is fluidly communicated to the space between element 42 and 44 bounded by the seal bore 32. In this condition, the insert valve 10 may be operated via pressure from the control line. However, if packing 40 or 50 leaks in either direction (from the control side pressure or from the tubing pressure side) fluid will infiltrate the chamber 22 and either cause the valve 10 to close or prevent the opening of valve 10. In either case, a leak past packing 40 or packing 50 in either direction (i.e., from the tubing pressure side or from the control pressure side) will allow fluid to move into the chamber 22 and thereby cause a fail-safe condition. The pathways implicated may be appreciated in schematic form in FIG. 2, which includes the components discussed above and also illustrates the flow tube piston 28 that is to be actuated by the control line pressure in volume 68 to force the flow tube 14 to move into contact with the flapper 12 (both illustrated schematically in this figure). The entirety of the chamber 22 is illustrated and where atmospheric pressure is directed to enable function of the insert valve 10.

In an embodiment hereof, the control portion 16 of the valve 10 requires more radial space in the housing 26 that a concentric bore for the flow tube 14 would support. Accordingly, insert valve 10 also includes an offset to the bore for the flow tube 14. In an embodiment, the offset is about 0.250 inch. This is illustrated in FIG. 1, where the deviation in the inside diameter of the valve 10 can be seen at deviation 70 and back at deviation 72. This provides the additional space needed in the now eccentric annular space of the housing 26 on one side of the housing.

Figure 6:
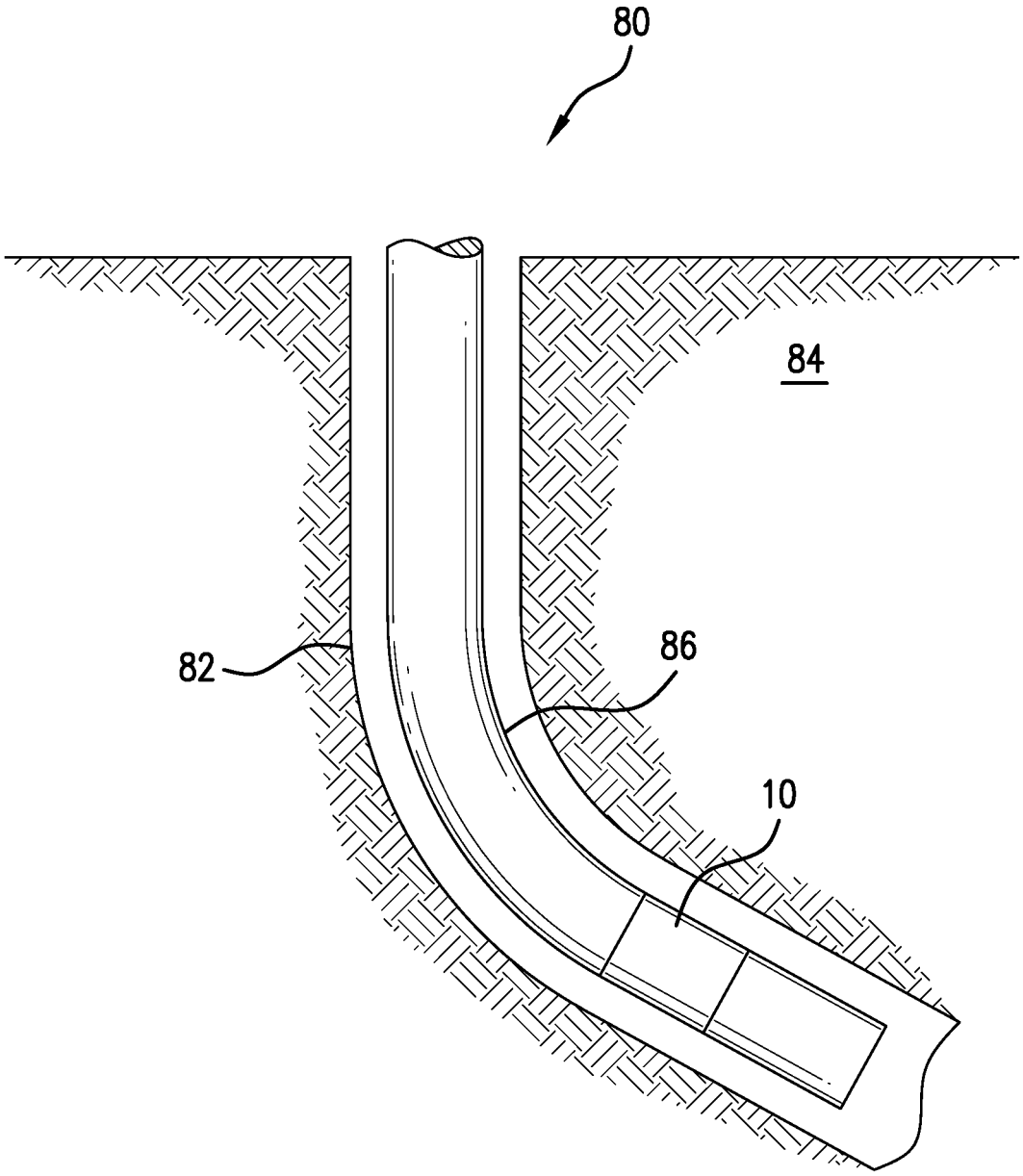
FIG. 6 is a view of a borehole system including the insert valve as disclosed herein.

Referring to FIG. 6, a borehole system 80 is illustrated. The system 80 comprises a borehole 82 in a subsurface formation 84. A string 86 is disposed within the borehole 82. An insert safety valve 10 as disclosed herein is disposed within or as a part of the string 86.

Set forth below are some embodiments of the foregoing disclosure:

Embodiment 1: An insert safety valve, including a housing, a flow tube movably disposed within the housing, a flapper articulated to the housing and responsive to positions of the flow tube relative to the housing, an atmospheric chamber disposed within the housing, a selectively openable valve disposed to prevent or allow pressure communication between the atmospheric chamber and an environment outside of the housing, the valve including a valve member, a valve seat, a biaser configured to urge the member against the seat, and an unseat member responsive to an external input to move the valve member off the valve seat.

Embodiment 2: The safety valve as in any prior embodiment, wherein the valve member is a poppet.

Embodiment 3: The safety valve as in any prior embodiment, wherein the biaser is a compression spring.

Embodiment 4: The safety valve as in any prior embodiment, wherein the unseat member is a mechanical member that physically moves the valve member away from the valve seat.

Embodiment 5: The safety valve as in any prior embodiment, wherein the unseat member is responsive to pressure input.

Embodiment 6: The safety valve as in any prior embodiment, wherein the unseat member is responsive to a mechanical input.

Embodiment 7: The safety valve as in any prior embodiment, wherein the mechanical input is by a seal, the seal being movable based upon application of pressure.

Embodiment 8: The safety valve as in any prior embodiment, wherein the pressure is applied from a control location.

Embodiment 9: The safety valve as in any prior embodiment, wherein the housing further defines a bore for the flow tube that is offset from an axial centerline of the housing.

Embodiment 10: A borehole system, including a preexisting safety valve having a control line, an insert safety valve as in any prior embodiment, disposed within the preexisting safety valve, the insert safety valve configured to operate based upon input from the control line.

Embodiment 11: The borehole system as in any prior embodiment, wherein pressure from the control line is the external input.

Embodiment 12: The borehole system as in any prior embodiment, wherein pressure from the control line causes movement of a packing element disposed on the insert safety valve and adjacent the unseat member.

Embodiment 13: A method for controlling a wellbore, including running the insert safety valve as in any prior embodiment to a location in a wellbore, preventing fluid communication with the atmospheric chamber of the safety valve during running, landing the insert safety valve, moving the unseat member, and enabling fluid communication with the atmospheric chamber.

Embodiment 14: The method as in any prior embodiment, wherein the moving of the unseat member is by moving a packing disposed on the housing adjacent the unseat member.

Embodiment 15: The method as in any prior embodiment, wherein the moving the unseat member includes physically moving the valve member with the unseat member.

Embodiment 16: The method as in any prior embodiment, wherein the physically moving includes wedging.

Embodiment 17: A wellbore system, including a borehole in a subsurface formation, a string in the borehole, and an insert safety valve as in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An insert safety valve, comprising:
- a housing;
- a flow tube movably disposed within the housing;
- a flapper articulated to the housing and responsive to positions of the flow tube relative to the housing;
- a sealed atmospheric chamber disposed within the housing, the atmospheric chamber being initially sealed off from an environment outside of the housing;
- a selectively openable valve disposed to prevent or allow pressure communication between the atmospheric chamber and an environment outside of the housing, the valve comprising:
  - a valve member;
  - a valve seat;
  - a biaser configured to urge the member against the seat; and
  - an unseat member responsive to an external input to move the valve member off the valve seat.

2. The safety valve as claimed in claim 1, wherein the valve member is a poppet.

3. The safety valve as claimed in claim 1, wherein the biaser is a compression spring.

4. The safety valve as claimed in claim 1, wherein the unseat member is a mechanical member that physically moves the valve member away from the valve seat.

5. The safety valve as claimed in claim 1, wherein the unseat member is responsive to pressure input.

6. The safety valve as claimed in claim 1, wherein the unseat member is responsive to a mechanical input.

7. The safety valve as claimed in claim 6, wherein the mechanical input is by a seal, the seal being movable based upon application of pressure.

8. The safety valve as claimed in claim 7, wherein the pressure is applied from a control location.

9. The safety valve as claimed in claim 1, wherein the housing further defines a bore for the flow tube that is offset from an axial centerline of the housing.

10. A wellbore system, comprising:
- a borehole in a subsurface formation;
- a string in the borehole; and
- an insert safety valve as claimed in claim 1, disposed within or as a part of the string.

11. A borehole system, comprising:
- a preexisting safety valve having a control line;
  - an insert safety valve, comprising:
    - a housing;
    - a flow tube movably disposed within the housing;
- a flapper articulated to the housing and responsive positions of the flow tube relative to the housing,
- an atmospheric chamber disposed within the housing;
- a selectively openable valve disposed to prevent or allow pressure communication between the atmospheric chamber and an environment outside of the housing, the valve comprising:
  - a valve member;
  - a valve seat;
  - an unseat member responsive to an external input to move the valve member off the valve seat,
- the insert safety valve disposed within the preexisting safety valve, the insert safety valve configured to operate based upon input from the control line.

12. The borehole system as claimed in claim 11, wherein pressure from the control line is the external input.

13. The borehole system as claimed in claim 11, wherein pressure from the control line causes movement of a packing element disposed on the insert safety valve and adjacent the unseat member.

14. A method for controlling a wellbore, comprising:
- running an insert safety valve, comprising:
  - a housing;
  - a flow tube movably disposed within the housing;
- a flapper articulated to the housing and responsive to positions of the flow tube relative to the housing;
- an atmospheric chamber disposed within the housing;
- a selectively openable valve disposed to prevent or allow pressure communication between the atmospheric chamber and an environment outside of the housing, the valve comprising:
  - a valve member;
  - a valve seat;
  - an unseat member responsive to an external input to move the valve member off the valve seat,
- to a location in a wellbore;
- preventing fluid communication with the atmospheric chamber of the safety valve during running;
- landing the insert safety valve;
- moving the unseat member; and
- enabling fluid communication with the atmospheric chamber.

15. The method as claimed in claim 14, wherein the moving of the unseat member is by moving a packing disposed on the housing adjacent the unseat member.

16. The method as claimed in claim 14, wherein the moving the unseat member includes physically moving the valve member with the unseat member.

17. The method as claimed in claim 16, wherein the physically moving includes wedging.

* * * * *